US006886289B1

(12) United States Patent
Rigler

(10) Patent No.: US 6,886,289 B1
(45) Date of Patent: May 3, 2005

(54) ELEVATION ADJUSTABLE FIREARM FRONT SIGHT WITH USER CHANGEABLE SIGHTING ELEMENT

(75) Inventor: Joseph W. Rigler, Rolla, MO (US)

(73) Assignee: R7BAR, LLC, Rolla, MO (US)

( * ) Notice: Subject to any disclaimer, the term of this patent is extended or adjusted under 35 U.S.C. 154(b) by 0 days.

(21) Appl. No.: 10/766,855

(22) Filed: Jan. 30, 2004

(51) Int. Cl.[7] ..... F41G 1/16
(52) U.S. Cl. ..... 42/136; 42/141; 42/142
(58) Field of Search ..... 42/136, 141, 142

(56) References Cited

U.S. PATENT DOCUMENTS

| | | | | | |
|---|---|---|---|---|---|
| 616,512 | A | * | 12/1898 | Wendelstadt | 42/136 |
| 2,030,312 | A | * | 2/1936 | Mossberg | 42/111 |
| 2,417,716 | A | * | 3/1947 | Swartz | 42/137 |
| 2,788,600 | A | * | 4/1957 | Pokorny | 42/138 |
| 3,495,339 | A | * | 2/1970 | Elliason | 42/137 |
| 3,641,676 | A | * | 2/1972 | Knutsen et al. | 42/136 |
| 3,648,374 | A | * | 3/1972 | Lewis | 42/136 |
| 3,662,469 | A | * | 5/1972 | Charron | 42/137 |
| 3,813,790 | A | * | 6/1974 | Kaltmann | 42/132 |
| 3,984,917 | A | * | 10/1976 | Korzeniewski | 42/138 |
| 4,021,926 | A | * | 5/1977 | Hrebar | 42/137 |
| 4,026,054 | A | * | 5/1977 | Snyder | 42/115 |
| 4,208,821 | A | * | 6/1980 | Power | 42/138 |
| 4,434,560 | A | * | 3/1984 | Comeyne | 42/132 |
| 4,574,335 | A | * | 3/1986 | Frimer | 362/84 |
| 4,575,961 | A | * | 3/1986 | Mikuta et al. | 42/136 |
| 4,677,782 | A | * | 7/1987 | Kaye et al. | 42/132 |
| 4,686,770 | A | * | 8/1987 | Aigner | 42/140 |
| 4,691,442 | A | * | 9/1987 | Center | 42/140 |
| 4,930,241 | A | * | 6/1990 | Zedrosser | 42/148 |
| 5,016,381 | A | * | 5/1991 | Ferraro | 42/148 |
| 5,070,619 | A | * | 12/1991 | Santiago | 42/144 |
| 5,222,302 | A | * | 6/1993 | DeBatty et al. | 42/121 |
| 5,359,800 | A | * | 11/1994 | Fisher et al. | 42/145 |
| 5,404,667 | A | * | 4/1995 | Schmitter | 42/111 |
| 5,493,450 | A | * | 2/1996 | Ekstrand | 359/799 |
| RE35,347 | E | * | 10/1996 | Bindon | 42/145 |
| 5,737,866 | A | * | 4/1998 | Minaire et al. | 42/90 |
| 5,806,228 | A | * | 9/1998 | Martel et al. | 42/124 |
| 5,864,957 | A | * | 2/1999 | Small | 42/111 |
| 6,035,539 | A | * | 3/2000 | Hollenbach et al. | 42/132 |
| 6,115,952 | A | * | 9/2000 | Rigler | 42/146 |
| 6,289,621 | B1 | * | 9/2001 | Vendetti et al. | 42/86 |
| 6,336,285 | B1 | * | 1/2002 | Baumer | 42/124 |
| 6,360,472 | B1 | * | 3/2002 | Lorocco | 42/132 |
| 6,643,970 | B2 | * | 11/2003 | Huber | 42/122 |
| 6,684,551 | B2 | * | 2/2004 | Howe | 42/132 |
| 6,722,075 | B1 | * | 4/2004 | Gabaldon | 42/141 |

* cited by examiner

*Primary Examiner*—Michael J. Carone
*Assistant Examiner*—John Richardson
(74) *Attorney, Agent, or Firm*—Michael W. York

(57) ABSTRACT

An elevation adjustable firearm front sight with user changeable sighting elements that includes a lower rotatable front sight insert member adapted to be secured to a firearm front sight base and an upper front sight insert member rotatably secured to the upper portion of the lower rotatable front sight insert member. The front sight insert member has a plurality of front sight elements that are selectable by the firearm user by rotating the upper front sight insert member that is rotatably secured to the upper portion of the lower rotatable front sight insert member. This sight has provisions for permitting the user to select the front sight element by rotating the front sight mounting member without changing the elevation setting of the front sight.

10 Claims, 4 Drawing Sheets

ELEVATION ADJUSTABLE FIREARM FRONT SIGHT WITH USER CHANGEABLE SIGHTING ELEMENT

BACKGROUND OF THE INVENTION

Many firearms have adjustable sights so that the sights can be adjusted to enable the firearm to hit what the shooter is aiming at. This is particularly true of rifles and the like that are expected to be fired at longer distances in situations where the impact of the fired bullets may shift due to such factors as gravity and wind that act upon the fired bullets. Many firearms have a fixed front sight with a variable rear sight that is adjustable for elevation and possibly also for windage. However, there are few firearms that have front sights that are adjustable for elevation.

The well known AR-15 or M-16 type or family of firearms is an example of a family or type that has an elevation adjustable front sight. The M-16 type front sight has an externally threaded lower conical portion that screws into a threaded hole in a sight base and the sighting elements is located on the outer end of the threaded portion. A circumferential flange with outer indentations is located around the base of the sight element and these indentations permit the threaded shaft to be rotated by the user by inserting the point of a bullet or the like into an indentation and then applying a lateral or rotatable force to cause the threaded shaft portion to be threaded into or out of the threaded hole in the sight base. When the threaded portion is threaded into the threaded hole, the front sight is lowered and the firearm will normally shoot higher. Conversely, when the threaded portion is screwed out of the threaded hole, the front sight is extended or elevated and the firearm will normally shoot lower.

It has been determined that it is beneficial to provide the shooter with two or more different front sight elements such as blades or posts. This gives the shooter a choice of front sight elements to suit his or her particular need or preference. For instance, a small blade type front sight might be desired for precision or target shooting but a larger size blade type sight might be desired for hunting game where speed is required and a larger sight is beneficial. Unfortunately, mounting such a dual convertible front sight on a rotating elevation adjustable front sight, so that it can be switched by the user, presents severe problems because, if the front sight is rotated to present a different front sight blade or the like, the rotation of the sight also moves the front sight up or down and this changes the point of impact of the bullet which is not acceptable.

This invention permits a rotatable elevation adjustable front sight to be used with a plurality of front sight elements such as blades, dots or the like without changing the elevation of the sight. Consequently, with this invention the shooter can readily change the front sight element to suit the particular shooting requirements without changing the point of impact of the bullets when the firearm is fired. In one embodiment of the invention a wide range of front sight elements can be readily substituted by the shooter. The front sight invention is capable of replacing the front sight in the M-16 type or family of firearms.

SUMMARY OF THE INVENTION

This invention relates to adjustable front sights and more particularly to an elevational adjustable front sight that has a threaded portion that screws into and out of a threaded hole in a front sight base to provide elevational adjustments.

It is therefore an object of the invention to provide an adjustable firearm front sight that has the capability of providing a plurality of front sight elements.

It is an object of the invention to provide an adjustable firearm front sight that has the capability of providing a plurality of front sight elements that can be chosen by the user of the firearm.

It is an object of the invention to provide an adjustable firearm front sight that has the capability of providing a plurality of front sight elements that can be chosen by the user of the firearm that is also adjustable by the user of the firearm for elevation.

It is an object of the invention to provide an adjustable firearm front sight that has the capability of providing a plurality of front sight elements that can be chosen by the user of the firearm that also adjustable by the user of the firearm for elevation where the user can select the the desired front sight element without changing the elevation setting.

It is an object of the invention to provide an adjustable firearm front sight that has the capability of providing a plurality of front sight elements that can be chosen by the user of the firearm that can replace the existing M-16 type firearm front sight.

It is object of the invention to provide an adjustable firearm front sight that has the capability of providing a plurality of front sight elements that can be chosen by the user of the firearm that is adapted to be rotatably secured in the existing threaded aperture for the existing M-16 type firearm front sight.

It is an object of the invention to provide an adjustable firearm front sight that has the capability of providing a plurality of front sight elements that can be chosen by the user of the firearm that is adapted to be rotatably secured in the existing threaded aperture for the existing M-16 type firearm front sight that is easy for the firearm user to install.

It is an object of the invention to provide an adjustable firearm front sight kit with a front sight that has the capability of providing a plurality of front sight elements that can be chosen by the user of the firearm that is adapted to be rotatably secured in the existing threaded aperture for the existing M-16 type firearm front sight that is easy for the firearm user to install that includes tools to assist the firearm user in installing and using the front sight.

It is an object of the invention to provide an adjustable firearm front sight that has the capability of providing a plurality of front sight elements that can be chosen by the user of the firearm that is also adjustable by the user of the firearm for elevation where the user can select the the desired front sight element without changing the elevation setting that has a plurality of removable front sight elements.

It is an object of the invention to provide an adjustable firearm front sight that has the capability of providing a plurality of front sight elements that can be chosen by the user of the firearm that is also adjustable by the user of the firearm for elevation where the user can select the the desired front sight element without changing the elevation setting that is simple in its operation.

It is an object of the invention to provide an adjustable firearm front sight that has the capability of providing a plurality of front sight elements that can be chosen by the user of the firearm that is also adjustable by the user of the firearm for elevation where the user can select the the desired front sight element without changing the elevation setting that is maintenance free.

It is an object of the invention to provide an adjustable firearm front sight that has the capability of providing a plurality of front sight elements that can be chosen by the user of the firearm that is also adjustable by the user of the firearm for elevation where the user can select the the desired front sight element without changing the elevation setting that does not wear out.

These and other objects of the invention will be apparent from the following description of the adjustable front sight invention that includes a lower rotatable front sight insert member adapted to be secured to a front sight base on the forward portion of a firearm barrel and an upper front sight insert member rotatably secured to the upper portion of the lower rotatable front sight insert member with the upper front sight insert member having a plurality of front sight elements that are selectable by the firearm user by rotating a portion of the upper front sight insert member that is rotatably secured to the upper portion of the lower rotatable front sight insert member. This front sight has element selecting and positioning means for permitting the user to select and position the front sight element for use by rotating a portion of the upper front sight insert member without changing the elevation setting of the front sight.

BRIEF DESCRIPTION OF THE DRAWINGS

The invention will be hereinafter described with reference to the accompanying drawings in which.

DETAILED DESCRIPTION OF THE PREFERRED EMBODIMENTS

Figure 1:
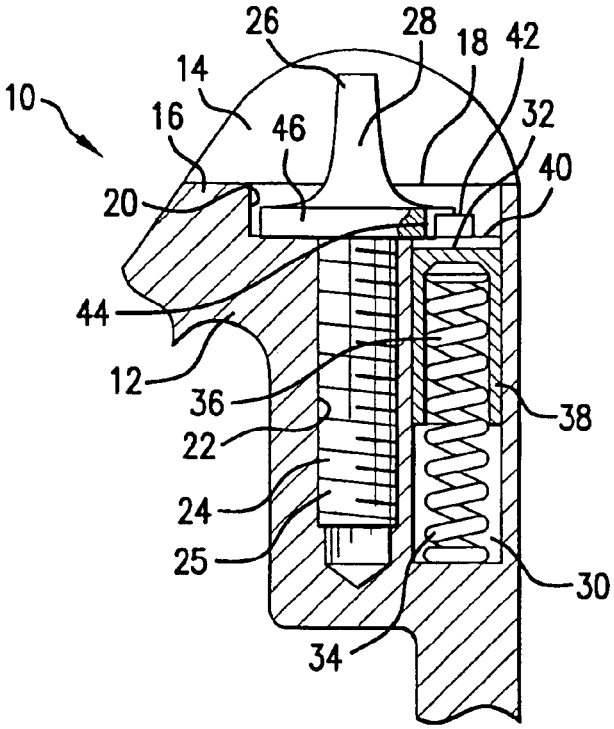
FIG.1 PRIOR ART
FIG. 1 is a side elevational view of the front sight area of a prior art M-16 type firearm with portions thereof broken away.

Referring first to FIG. 1, a side elevational view of a prior art M-16 type elevation adjustable front sight with portions broken away and in section is illustrated and is designated generally by the number 10. The M-16 type sight 10 comprises a front side body 12 with conventional front sight protectors 14 located on its upper end portion 16. For clarity only one front sight protector 14 is illustrated. A generally flat surface 18 is located between the sight protectors 14 and a shallow depression 20 is located in this surface 18. A conventional threaded hole 22 extends downward into the front sight body 12 from the depression 20 and this threaded hole 22 is sized and shaped to accept a conventional prior art front sight insert 24 with its threaded portion 25. The sight insert 24 has a conventional front sight post 26 on its upper end portion 28. An unthreaded hole 30 is located in front of the threaded hole 22 and extends downward from the depression 20 into the front sight body 12 parallel to the threaded hole 22. This unthreaded hole 30 contains a conventional generally cylindrical detent 32 and a detent coil spring 34 that is located in the hole 30 below the detent 32 with a portion 36 that extends into a hollow cylindrical open bottom portion 38 in the detent 32. The upper surface 40 of the detent 32 has a short cylindrical projection 42 that is sized and shaped to fit into a semicircular cut out portion or indentation 44 in the circular flange portion 46 of the upper end portion 28 of the front sight insert 24.

In order to use the prior art front sight 10 to adjust it for the changes in elevation, the user pushes downward on the cylindrical projection 42 with the point of a bullet or the like so that the projection 42 is pushed below the flange portion 46. With the same bullet point (not shown) side pressure can be exerted on the edge of the cut out portion 44 to cause the sight insert 24 to rotate clockwise or counterclockwise. This rotational movement causes the front sight post 26 to move upward or downward due to the threaded portion 25 and the threaded hole 22. Consequently, the prior art front sight 10 is adjustable for elevation.

Figure 2:
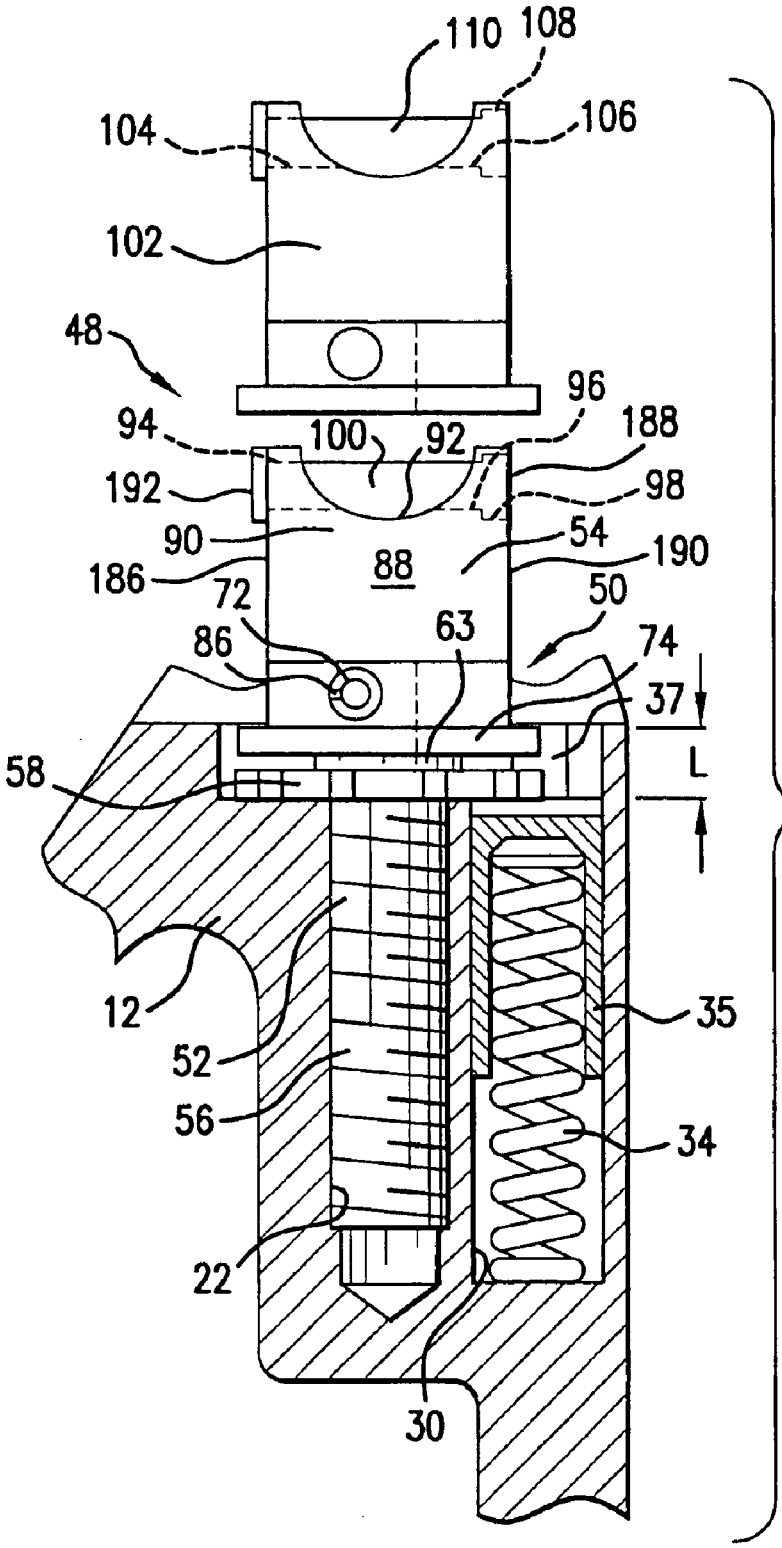
FIG. 2 is a side elevational view of the front sight area of an M-16 type firearm with the adjustable front sight invention with portions thereof broken away.

The elevation adjustable firearm front sight with user changeable sighting element of this invention is set forth in FIG. 2 as well as FIGS. 3, 4, 5 and 6 and is designated generally by the number 48. As indicated in FIG. 2, the adjustable front sight invention 48 uses the existing prior art M-16 front sight body 12 with the shallow depression 20, the threaded hole 22, and unthreaded hole 30. The front sight invention 48 also uses the existing detent coil spring 34, but uses a different detent 35 that has a longer cylindrical projection 37 that has a length L.

Figure 3:
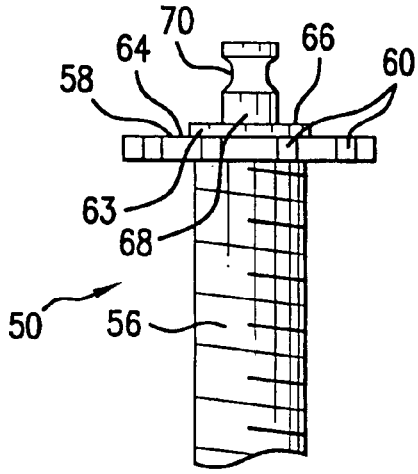
FIG. 3 is a side elevational view of the lower portion of the adjustable front sight invention set forth in FIG. 2
Figure 4:
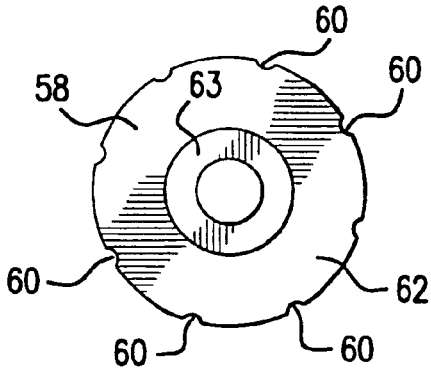
FIG. 4 is a top plan view of the lower portion of the adjustable front sight invention set forth in FIG. 2.

The adjustable sight invention 48 uses basically a two piece front sight insert 50 in place of the prior art single piece front sight insert 24. The two piece front sight insert 50 has a lower front sight insert member 52 and an upper front sight insert member 54. The lower front sight insert member 52 has a lower threaded portion 56 that is sized and shaped to be threaded into the threaded hole 22 in the front sight body. As illustrated in FIGS. 2, 3 and 4, a thin circular shaped flange portion 58 is located immediately above the threaded portion 56. This circular shaped flange portion 58 has a series of semicircular cut out portions 60 located in the outer circumferential portion 62 of the flange portion 58. A raised circular shaped bearing portion 63 extends upward from the upper surface 64 of the flange portion 58 and this bearing portion 63 has an outer circular shaped bearing surface 66. A connecting projection 68 extends upward from the bearing surface 66. A portion of this connecting projection 68 has a circumferential semicircular groove 70 in its outer surface that is sized and shaped to accept a portion of a roll pin 72.

Figure 5:
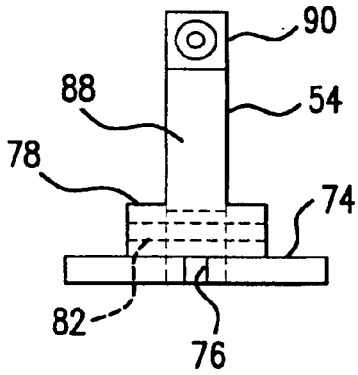
FIG. 5 is a front elevational view of the upper portion of the adjustable front sight invention set forth in FIG. 2.
Figure 6:
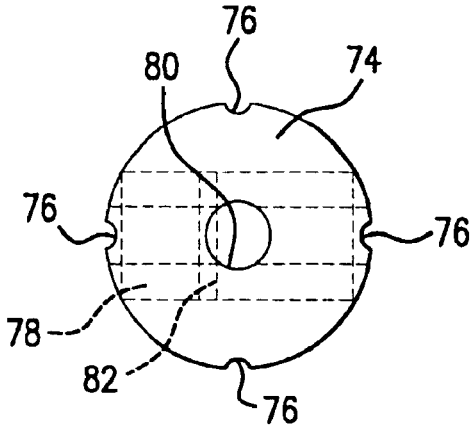
FIG. 6 is a bottom plan view of the upper portion of the adjustable front sight invention set forth in FIG. 2.

As illustrated in FIG. 2, the upper front sight insert member 54 is located immediately above the lower front sight insert member 52. As illustrated in FIGS. 2, 5 and 6, the upper front sight insert member 54 has a thin enlarged circular shaped lower flange portion 74 whose central portion rests upon the bearing portion 63 of the lower front sight insert member 52. The lower flange portion 74 has four identical semicircular cut out indentations 76 in its outer circumferential surface. An enlarged generally rectangular support portion 78 is located immediately above the flange portion 74. A hole 80 is centrally located in the flange portion 74 and extends into the support portion 78 and this hole 80 is sized and shaped to receive the connecting projection 68 that is located on the upper portion of the lower front sight insert member 52. The support portion 78 has a hole 82 extending through it that is sized and shaped to receive the roll pin 72.

The hole 82 is located in the support portion 78 so that a portion of the roll pin 72 fits into the semicircular groove 70 in the connecting projection 68. In this manner the upper front sight insert member 54 is rotatably connected to the lower front sight insert member 52. It is important to note that the roll pin 72 is installed with its slot portion 86 located outward or away from the semicircular groove 70 in the connecting projection 68.

A thin generally rectangular shaped front sight blade portion 88 extends upward from the support portion 78. The upper end portion 90 of the front sight blade portion 88 has a semicircular cut out portion 92 and two circular holes 94 and 96 that are on the same axis extend through the upper end portion 90 of the front sight blade portion 88. The hole 96 has an enlarged outer counter bored section 98. A fiber optic front sight insert member 100 is sized and shaped to fit into the respective holes 94 and 96 as well as the counter bored section 98. When installed, the fiber optic rod insert member 100, of a color of the user's selection, is melted by heat at both ends. At the counter bored hole 98 the rod insert member 100 melts into the counter bored section 98, retaining the fiber optic rod insert member 100 and providing a small visual sighting reference dot 188. The circular hole 94 at the other end of the blade portion 88 is configured so that the fiber optic rod insert member 100 melts outside the hole 94 when heated to provide a larger slighting reference dot 192 for the user. By rotating the blade portion 88, the user can select the small or large sight reference dot 188 or 192. Although a heat melted fiber optic rod insert member 100 is described in connection with the preferred embodiment of the invention 48, it will be understood by those skilled in the art that other types of insert members and the like my be used in place of the fiber optic rod insert member 100 that has heat melted ends.

As indicated in FIG. 2, an alternative upper front sight insert member designated generally by the number 102 is also provided. This upper front sight insert member 102 is substantially the same as the previously described upper front sight insert member 54 except that the dimensions for the circular holes 104 and 106, and the counter bore section 108 for the fiber optic front sight insert member 110 are greater than those for the same holes 94 and 96, the counter bore 98 and the fiber optic insert front sight insert member 100 of the upper front sight insert member 54. This extra alternative upper front sight insert member 102 allows the user of the front sight 48 to select a different fiber optic front sight insert member that has dimensions or color that are suitable for his or her shooting needs. To install the upper front sight insert member 102, the roll pin 72 is removed from the hole 82 in a conventional manner. Then, the upper front sight insert member 54 is removed and the upper front sight insert member 102 is installed in its place on the lower front sight insert member 52 and the roll pin 72 is inserted into the hole 82.

FIGS. 7, 8, 9 and 10 illustrate an alternative embodiment for the upper front sight insert member 54 and this alternative is designated generally by the number 112 and is adapted to be used with the previously described the lower front sight insert member 52. As illustrated in FIGS. 7 through 10, the alternative embodiment 112 comprises an upper front sight base member 114 and a removable front sight blade member 116. The upper front side base member 114 has a thin enlarged circular shaped lower flange portion 118 whose central portion rests upon the bearing portion 63 of the lower front sight insert member 52. The lower flange portion 118 is identical to the previously described flange portion 74 and it has four identical semicircular cut out portions or indentations 120 in its outer circumferential surface that are identical to the cut out portions or indentations 76 of the previously described flange portion 74. An enlarged generally rectangular support portion 122 is located immediately above the flange portion 118 and a hole 124 is centrally located in the flange portion 118 and extends into the support portion 122. This hole 124 is sized and shaped to receive the connecting projection 68 that is located on the upper portion of the lower front sight insert member 52. The support portion 122 has a hole 128 extending through it that is sized and shaped to receive the previously described roll pin 72 that is installed in the previously indicated manner.

The support portion 122 has truncated upside down shaped projection 130 extending upward from its upper surface 132. this projection 130 fits into a groove 134 that is located in the lower surface 136 of the front sight blade member 116. This groove 134 is sized and shaped to tightly receive the projection 130. The rest of the removable front sight blade member 116 is similar to the previously described front sight blade portion 88. A semicircular cut out portion 138 is located in the upper end portion 140 of the front sight blade member 116. Two circular holes 142 and 144 that are on the same axis extend through the upper end portion 140 of the front sight blade member 116 and the hole 144 has an enlarged outer counter bored section 146. A fiber optic front sight insert member 148 is sized and shaped to fit into the respective holes 142 and 144 as well as the counter bored section 146. This fiber optic front sight insert member 148 is melted at its ends by heat in the previously described manner with reference to the fiber optic insert member 100. A threaded hole 150 extends downward through the front sight blade member 116 to the upper portion of the groove 134. A threaded set screw 152 is threaded into the threaded hole 150 and its lower end portion is tightened, using a conventional screw driver, against the upper surface 156 of the projection 130 to lock or secure the projection 130 in place within the groove 134 so that the front sight blade member 116 is secured to the front sight base member 114. It should be noted that a circular cross section hole 157 extends through the fiber optic front sight insert member 148 adjacent the threaded hole 150 to permit access to threaded hole 150. This hole 157 is of sufficient size to accept that shaft and tip of a conventional small screw driver.

Figure 7:
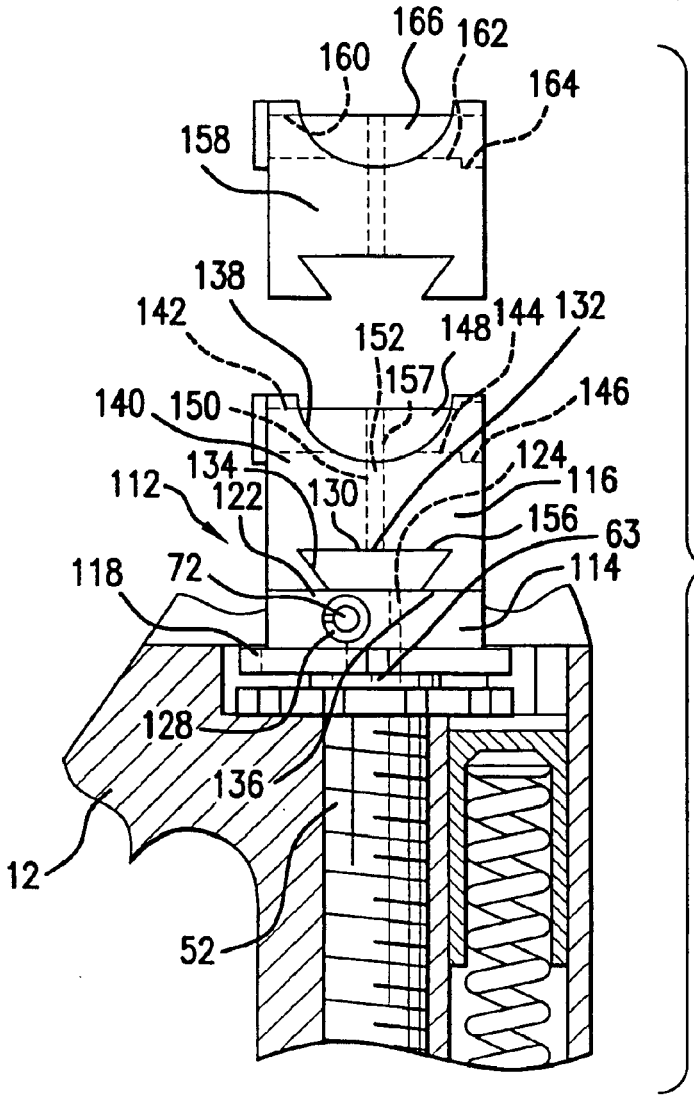
FIG. 7 is a is a side elevational view of the front sight area of an M-16 type firearm with an additional embodiment of the adjustable front sight invention with portions thereof broken away.
Figure 8:
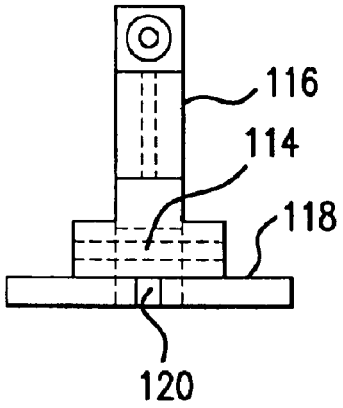
FIG. 8 is a front elevational view of the upper portion of the adjustable front sight invention set forth in FIG. 7.
Figure 9:
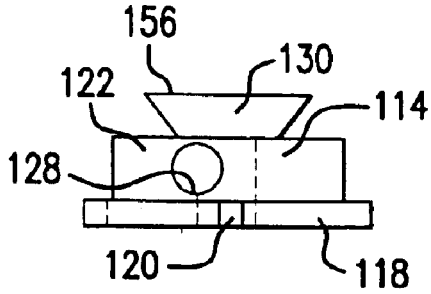
FIG. 9 is a side elevational view of the portion of the upper portion of the adjustable front sight invention set forth in FIG. 8.
Figure 10:
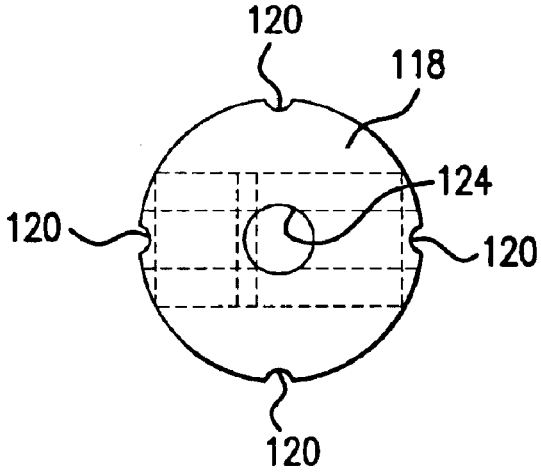
FIG. 10 is a bottom plan view of the portion of the upper portion of the adjustable front sight invention set forth in FIG. 9.

As indicated in FIG. 7, one or more alternative front sight blade members may be provided, only one of which is illustrated and is designated generally by the number 158. This alternative front sight blade member 158 is substantially identical to the previously described front sight blade member 116 except that the dimensions for the circular holes 160 and 162, and the counter bore 164 for the fiber optic front sight insert member 166 are different than those for the same holes 142 and 144, the counter bore 146 and the fiber optic insert front sight insert member 148 of the front sight blade member 116. The extra alternative front sight blade members such as the front sight blade member 158 allow the user of the front sight 48 the ability to readily select a different fiber optic front sight insert member that has dimensions or color that are suitable for his or her shooting needs.

Figure 11:
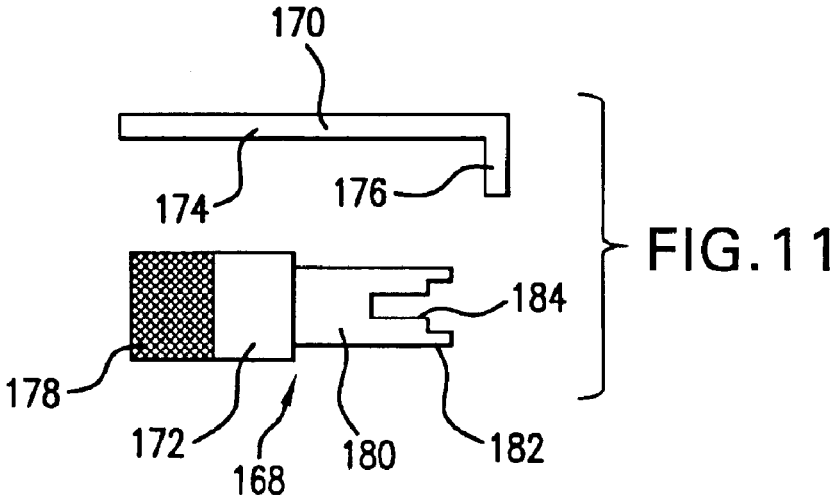
FIG. 11 is a side elevational view of a tool kit for use with the upper portion of the adjustable front sight invention set forth in FIGS. 2 through 9.

In the preferred embodiment, the elevation adjustable firearm front sight with the user changeable sighting element 48 or the alternative embodiment with the upper front sight insert member 112 is supplied with a tool kit that is set forth in FIG. 11 and is designated by the number 168. The tool kit 168 comprises a detent tool 170 and a front sight tool 172. The detent tool 170 comprises an L-shaped member with a long straight handle portion 174 and an adjacent shorter straight tool portion 176 that has its along axis at 90 degrees to the long axis of the long straight handle portion 174. The front sight tool 172 has a circular cross section handle portion 178 and an adjacent smaller diameter circular cross section tool portion 180 whose outer end portion 182 has a stepped shaped indentation 184 that is shaped and sized to receive the front sight blade portion 88 and a portion of the support portion 78 of the front sight 48 or the equivalent structure of the other embodiment.

The elevation adjustable firearm front sight with a user changeable sighting element invention 48 illustrated in FIGS. 2 through 6 is made in a conventional manner using conventional machining techniques and conventional materials and finishes known in the art. The same is true for the alternative embodiment for the upper front sight insert member 54 that is designated generally by the number 112 and is illustrated in FIGS. 7 through 10.

The front sight invention 48 is used in the following manner. First, the conventional front sight insert 24 is removed from the threaded hole 22 in the front sight body 12. This is a accomplished by depressing the cylindrical projection 42 of the detent 32 using the point of a bullet or some other suitable object or the short end 176 of the detent tool 170. While the detent projection 42 is depressed, the front sight insert 24 is rotated in a conventional manner in a counter clockwise direction until the front sight insert 24 is free from the threaded hole 22 in the front sight body 12.

After the front sight insert 24 is removed from the hole 22, the prior art detent 32 is also removed and it is replaced by the new detent 35 that has the longer cylindrical projection 37. Then the two piece front sight insert 50 is mounted in the prior art threaded hole 22 in the front sight body 12. In doing this, the lower front sight insert 52 with its lower threaded portion 56 is threaded into the threaded hole 22. To do this the new detent 35 will be depressed by using the tool portion 176 of the detent tool 170 to depress the detent 35. The lower front sight insert member 52 is rotated through the use of its circular shaped flange portion and its cut out portions 60 to achieve the desired elevation for the two piece insert 50.

Once the proper elevation has been set, the user can then select the end of the fiber optic insert member 100 that the user wants to view when using the front sight 48. In this connection, it should be noted that the circular hole 96 for the fiber optic insert member 100 has an enlarged counter bored section 98 with the smaller melted visual sight reference whereas the circular hole 94 in the opposite end of the front sight blade portion 88 does not have the confining counter bore and the adjacent heat melted sight reference is larger.

Consequently, in view of the previous discussion related to the heat melting of the ends of the fiber optic rod insert member 100, the user that is viewing the end 186 of the blade portion will see a large fiber optic dot 192 and the user that is viewing the opposite end 190 of the blade portion 88 will see a much smaller fiber optic dot 188 that is confined by the outer counter bored section 98 for the front sight fiber optic insert member 100. To select the proper fiber optic dot 188 or 192, the user depresses the projection 37 of the detent 35 using the tool portion 176 of the detent tool 170 to depress the projection 37 of the detent 35 just sufficiently so that the detent projection 37 clears the lower flange portion 74, but not the flange portion 58 of the lower front sight insert member 52. This allows the elevation setting to remain fixed since the projection 37 of the detent 35 is still in one of the cut out portions 60 in the flange portion 58 and hence the lower front sight insert member 50 cannot rotate and change the elevation setting of the front sight 48. The user then rotates the front sight blade portion 88 so that the desired fiber optic dot 188 or 192 is facing to the rear and can be used for sighting purposes. This rotation of the front sight blade portion 88 is best accomplished by the user using the front sight tool 172 and by placing the stepped shaped indentation 184 over the upper end portion 90 of the front sight blade portion 88 and twisting the front sight tool 172.

The other front sight blade portions are rotated into the desired positions in the same manner as the front sight blade portion 88. Also, the rotation for the upper front sight insert member 112 is accomplished in an identical manner. However, if it is desired that the front sight blade member 116 be changed, then the set screw 152 is loosened and the projection 130 is moved laterally out of the groove 134 of the front sight blade member 116. Then, an alternative front sight blade member 158 is placed onto the projection 130 and the set screw 152 is inserted and used to secure the front sight blade member 158 in place on the front sight base member 114 in the same manner as the the front sight blade member 116.

Although the invention has been described in considerable detail with reference to certain preferred embodiments, it will be understood that variations or modifications may be made within the spirit and scope of the invention as defined in the appended claims.

What is claimed is:

1. An elevation adjustable firearm front sight with user changeable sighting element for mounting on a firearm front sight base comprising a rotatable front sight base adapted to be rotatably secured to the firearm front sight base, the rotatable front sight base being adapted to provide elevational adjustment for the user changeable sighting element and having a threaded portion sized and shaped to be rotatably secured to the firearm front sight base, and a front sight mounting member movably secured to a portion of the rotatable front sight base, the front sight mounting member having a plurality of sighting elements adapted to be selected and positioned for use by the user of the firearm sight with at least one of the plurality of sighting elements comprising a fiber optic member.

2. The elevation adjustable firearm front sight of claim 1 wherein the fiber optic member has at least one heat melted portion.

3. The elevation adjustable firearm front sight of claim 1 wherein the front sight mounting member is rotatable independently of the rotatable front sight base.

4. The elevation adjustable firearm front sight of claim 1 wherein the elevation adjustable firearm front sight is adapted to replace the M-16 type firearm front sight.

5. The elevation adjustable firearm front sight of claim 4 wherein the firearm front sight base is an M-16 type firearm front sight base with a threaded hole and the threaded portion of the rotatable front sight base is sized and shaped to be to be rotatably secured to the M-16 type firearm front sight base by being threaded into the threaded hole in the M-16 type firearm front sight base.

6. An elevation adjustable firearm front sight with user changeable sighting element for mounting on a firearm front sight base comprising a rotatable front sight base adapted to be rotatably secured to the firearm front sight base, the rotatable front sight base being adapted to provide elevational adjustment for the user changeable sighting element and having a threaded portion sized and shaped to be rotatably secured to the firearm front sight base, and a front sight mounting member movably secured to a portion of the rotatable front sight base, the front sight mounting member being rotatable independently of the rotatable front sight base and having a plurality of sighting elements adapted to be selected and positioned for use by the user of the firearm sight.

7. The elevation adjustable firearm front sight of claim 6 further comprising means for assisting the firearm user in changing the position of the sighting element.

8. The elevation adjustable firearm front sight of claim 7 wherein the means for assisting the firearm user in changing the position of the sighting elements comprises at least one tool.

9. The elevation adjustable firearm front sight of claim 6 wherein the elevation adjustable firearm front sight is adapted to replace the M-16 type firearm front sight.

10. The elevation adjustable firearm front sight of claim 9 wherein the firearm front sight base is an M-16 type firearm front sight base with a threaded hole and the threaded portion of the rotatable front sight base is sized and shaped to be to be rotatably secured to the M-16 type firearm front sight base by being threaded into the threaded hole in the M-16 type firearm front sight base.

* * * * *